US005974607A

United States Patent [19]

Smith

[11] Patent Number: 5,974,607

[45] Date of Patent: Nov. 2, 1999

[54] HEAD CLIP PILLOW

[75] Inventor: Devron P. Smith, Crossville, Tenn.

[73] Assignee: VK Industries, Crossville, Tenn.

[21] Appl. No.: 09/205,122

[22] Filed: Dec. 3, 1998

[51] Int. Cl.[6] ..... A47G 9/00

[52] U.S. Cl. ..... 5/636; 5/643; 5/645; 297/393

[58] Field of Search ..... 5/636, 637, 640, 5/643, 639; 297/393

[56] References Cited

U.S. PATENT DOCUMENTS

| | | | |
|---|---|---|---|
| 3,480,976 | 12/1969 | Yavner | 5/639 |
| 4,285,081 | 8/1981 | Price | 5/637 |
| 4,447,922 | 5/1984 | Brochu | 5/637 |
| 5,313,678 | 5/1994 | Redewill | 5/636 X |
| 5,778,469 | 7/1998 | Festa | 297/393 X |
| 6,168,590 | 12/1992 | O'Sullivan | 5/639 |

*Primary Examiner*—Michael F. Trettel
*Attorney, Agent, or Firm*—Pitts & Brittian, P.C.

[57] ABSTRACT

A head clip pillow is designed for being worn about the neck of a user to cover the user's ears in order to eliminate a substantial portion of ambient noise while providing support for the user's head. The pillow defines a substantially U-shaped configuration for being received about the back of the neck of a user. The central portion of the pillow defines a height to be received by the nape of the neck, while the terminal portions of the pillow define a height to cover the sides of the user's face, including the ears. A base member fabricated from a resilient material defines a contour substantially proportional to the overall contour of the pillow. A spring member is received about a portion of the base member. The spring member is configured to apply a biasing force about the neck of the user. Pressure applied to other areas of the user's head is accomplished indirectly through the base member. Surrounding the base member and spring is at least one layer of foam rubber or other cushioning type material. A cover is provided for maintaining the integrity of the internal pillow components. The cover is configured to be closely received about the entirety of the pillow to provide a smooth surface over the entire surface thereof. A removable cover is provided to protect the pillow and may be removed for cleaning or replacement thereof. An alternate embodiment includes a pocket defined on the interior of each side of the removable cover. The pocket has a convention closure device and is configured to receive a therapeutic treatment device such as a conventional hot/cold pack.

18 Claims, 5 Drawing Sheets

HEAD CLIP PILLOW

TECHNICAL FIELD

This invention relates to the field of head rests. More specifically, the present invention is related to a head rest for being worn by a user to cover at least the user's ears, and for use during therapeutic applications and during rest.

BACKGROUND ART

In the field of therapeutic devices, it is well known to adapt pillows and other head rests to particular applications. Particularly, there are many various contoured pillows provided for enabling more relaxed sleep patterns by conforming to particular features of one's head and neck. Other pillows are constructed from various materials to perform various functions, including supporting the head, dissipating heat radiated from the head, and the like. Such a variety in pillow and head rest constructions is a result of the well known need to provide support for a wide variety of head and neck shapes, as well as a wide variety of sleeping disorders and other physical ailments that, for example, require application of some treatment to the head, face or neck. Typical therapeutic applications include application of hot or cold packs to the face.

U.S. Pat. No. 673,872, issued to C. Von Hillern-Flinsch on May 14, 1901, discloses a head and neck support. A curved air cushion or bolster is provided to extend around a user's neck, and a cushion attached to the air cushion or bolster is provided for supporting the head when the user is in a seated position. The latter cushion is removably attached to the former such that it can be used to provide support for either side of the head. However, the '872 device does not provide a means for supporting the head while also covering both ears in such a manner as to filter sound. Nor does the '872 device provide a means whereby hot and/or cold treatments may be applied to the sides of the head of the user.

G. W. E. Price, in U.S. Pat. No. 4,285,081, issued on Aug. 25, 1981, discloses a device for providing support to the head and neck while in a prone position. One embodiment of the '081 device is configured to conform to the nape of the neck. However, the '081 device fails to provide a means for covering the ears, or for allowing the application of hot and/or cold treatments to the user's head.

In U.S. Pat. No. 5,313,678, issued on May 24, 1994, F. H. Redwill discloses an acoustical pillow. The pillow defines a substantially "U"-shaped configuration for being received about the back of a user's head. The ends of the pillow are received over the user's ears. The pillow is held in position by the user when the user is lying on his/her back and the central portion of the pillow is disposed between the user's head and the surface on which the user is resting. Headphones are disposed within the pillow and positioned to cover the ears when worn be the user. A spring is connected between the speakers in order to bias the speakers toward the user's ears. However, the biasing force required to hold the pillow on the user is too great to apply to the ears. Accordingly, the spring cannot hold the pillow in place when the user arises. Further, the '678 device does not provide a means for applying hot and/or cold treatments to the user's head.

U.S. Pat. No. 5,505,523, issued to F. L. Wang on Apr. 9, 1996, discloses a cushion for supporting the head of a user when in a seated position. The '523 device is releasably mounted on a chair back. Two wing portions defined by the '523 device are spaced apart to receive a user's head, with a buckled strap being received around the front of the wing portions in order to prevent the user's head from deforming one wing portion to an extent that the head is released. Although one ear may be covered at a time, as the user leans toward one or the other wing portion, the opposite ear becomes uncovered. By virtue of the structure of the '523 device, it may not be worn by the user such that the user may be mobile while the device is in place. Further, the '523 device fails to provide a means for the application of a hot and/or cold treatment to the user's head.

U.S. Pat. No. 5,778,469, issued to J. P. Festa on Jul. 14, 1998, discloses a therapeutic cervical pillow configured to received about the neck of the user. The pillow is comprised of two side portions which are pivotally connected to a back portion. The construction of the pillow includes a central core fabricated of a stiff material. The central core is surrounded with a foam material and finally an external fabric. Festa further discloses that the pillow may be mounted on the head rest of a vehicle seat for use when traveling. However, the Festa device is not configured to cover the ears of the user. Nor is it configured to provide a means for applying hot and/or cold therapy to the head of the user. Nor is the Festa pillow disclosed as having any biasing means for maintaining the pillow around the neck of the user.

These devices are typical of those provided heretofore. Several deficiencies in the prior art as discussed above include the failure to provide a biasing device for maintaining the position of the device on the head of the user such that the user may be mobile. Further, the prior art discussed above does not provide a means for comfortably covering the ears of the user to eliminate a substantial portion of the ambient noise in the environment of the user. Further, there are no provisions for the application of therapeutic treatments, such as hot and/or cold packs, to the face of the user.

Therefore, it is an object of this invention to provide a pillow configured to be worn about the neck of a user to cover the user's ears in order to eliminate a substantial portion of ambient noise.

Another object of the present invention is to provide such a device whereby a biasing device is provided to apply sufficient force about the user's neck to maintain the pillow on the neck and over the ears of the user without creating discomfort to the user.

Still another object of the present invention is to provide a pillow configured to be worn about the neck and over the ears of a user and whereby the application of therapeutic treatment is accommodated.

DISCLOSURE OF THE INVENTION

Other objects and advantages will be accomplished by the present invention which is designed for being worn about the neck of a user to cover the user's ears in order to eliminate a substantial portion of ambient noise while providing support for the user's head. The pillow of the present invention is provided with a biasing device for applying sufficient force about the user's neck to maintain the pillow on the neck and over the ears of the user without creating discomfort to the user. In an alternate embodiment, the pillow is provided with a means for accommodating the application of therapeutic treatment such as hot/cold therapy.

The pillow of the present invention defines a substantially U-shaped configuration for being received about the back of the neck of a user. The central portion of the pillow defines a height to be received by the nape of the neck, while the terminal portions of the pillow define a height to cover the sides of the user's face, including the ears. A base member is fabricated from a resilient material and is formed in any conventional manner such as by die cutting, molding, or other similar process. The base member defines a contour substantially proportional to the overall contour of the pillow, with a central portion relatively narrow with respect to the terminal portions.

A spring member is received about a portion of the base member. The spring member is configured to apply a biasing force about the neck of the user. Pressure applied to other areas of the user's head is accomplished indirectly through the base member. The spring is fabricated from a resilient material and is either die cut or injection molded. The spring may be integrally molded with the base member. When separately formed, the spring member is secured to the base member in a conventional manner such as by rivets, ultrasonic welding, cementing, or the like. Surrounding the base member and spring is at least one layer of foam rubber or other cushioning type material. Conventional materials such as foam rubber, cotton or synthetic batting, and other materials are used individually or in combination to achieve varying results. A cover is provided for maintaining the integrity of the internal pillow components. The cover is configured to be closely received about the entirety of the pillow to provide a smooth surface over the entire surface thereof. A removable cover is provided to protect the pillow and may be removed for cleaning or replacement thereof.

An alternate embodiment of the present invention includes a pocket defined on the interior of each side of the removable cover. The pocket has a convention closure device and is configured to receive a therapeutic treatment device such as a conventional hot/cold pack.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A head clip pillow incorporating various features of the present invention is illustrated generally at 10 in the figures. The head clip pillow, or pillow 10, is designed for being worn about the neck of a user to cover the user's ears in order to eliminate a substantial portion of ambient noise. The pillow of the present invention is provided with a biasing device 22 for applying sufficient force about the user's neck to maintain the pillow 10 on the neck and over the ears of the user without creating discomfort to the user. In an alternate embodiment, the pillow 10 is provided with a means for accommodating the application of therapeutic treatment 36.

Figure 1:
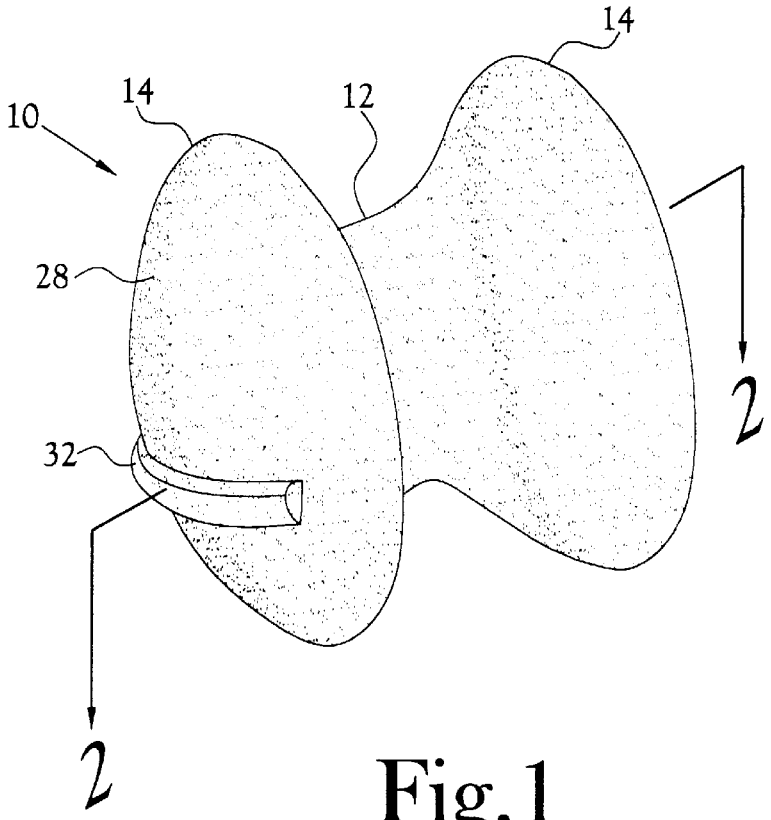
FIG. 1 is a perspective view of the head clip pillow constructed in accordance with several features of the present invention.

As illustrated in FIG. 1, the pillow 10 of the present invention defines a substantially U-shaped configuration (see also FIG. 2) for being received about the back of the neck of a user. The central portion 12 of the pillow defines a height to be received by the nape of the neck, while the terminal portions 14 of the pillow define a height to cover the sides of the user's face, including the ears. These relative dimensions of the pillow 10 are more clearly illustrated in FIG. 7. It will be understood by those skilled in the art that the pillow 10 may define various overall sizes to accommodate users of various sizes.

A removable cover 28 is provided for removal thereof for cleaning or replacement. A zipper flap 32 is illustrated in FIG. 1 to cover a zipper 30 (see FIG. 4) provided for accomplishing removal of the removable cover 28. Other conventional mechanisms such as hook-and-lop fasteners and the like for removably securing the removable cover 28 on the pillow 10 may be used as well.

Figure 2:
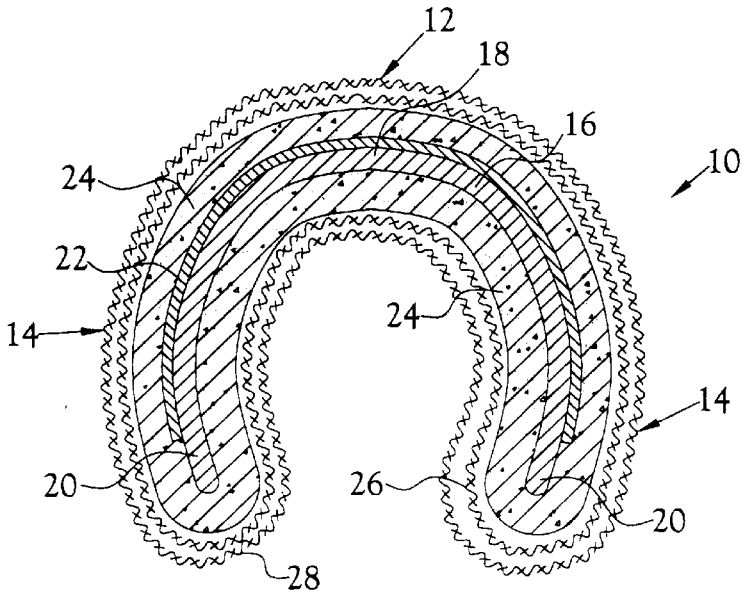
FIG. 2 is a top plan view, in section, of the head clip pillow taken at 2—2 of FIG. 1.
Figure 7:
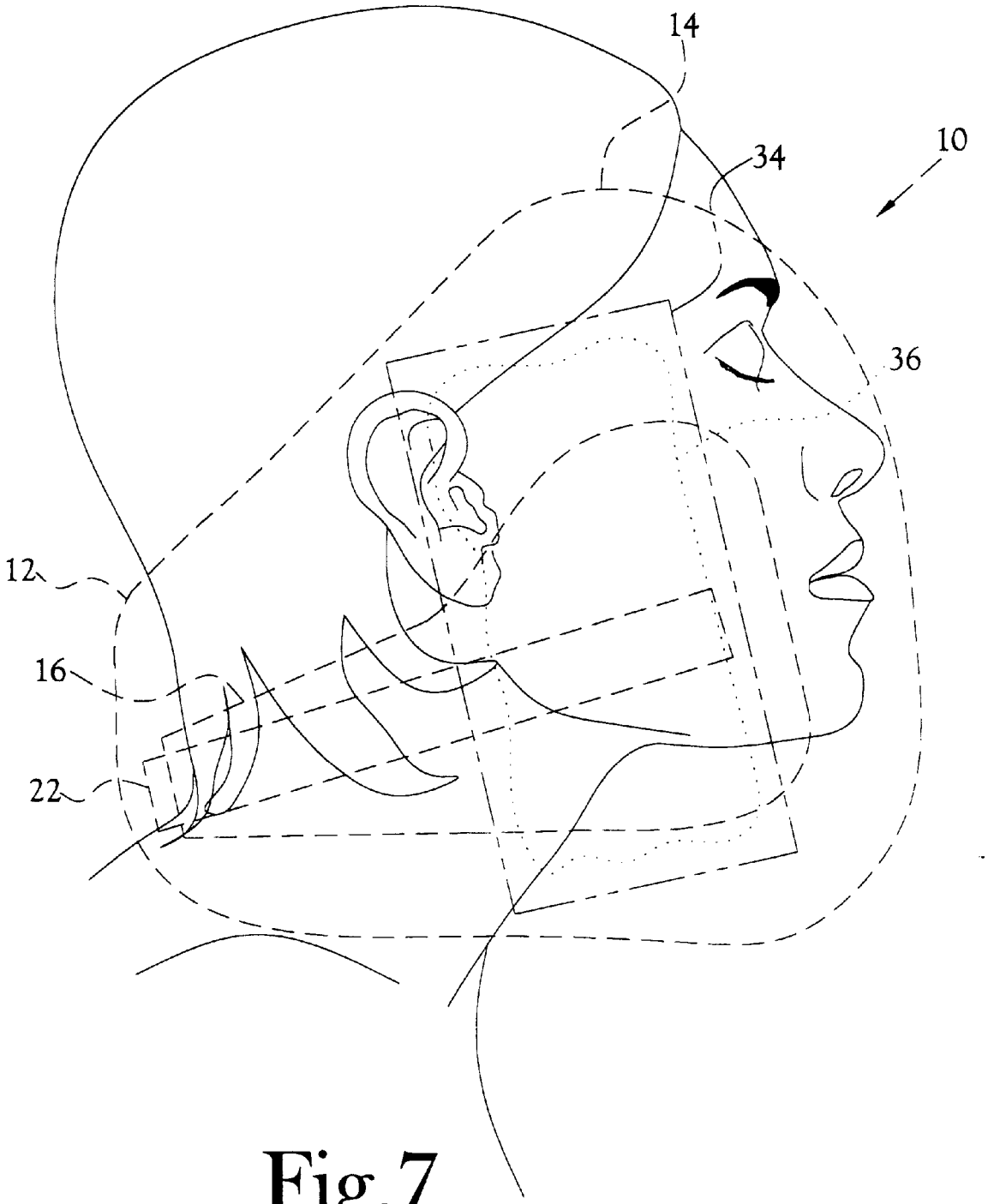
FIG. 7 is a side elevation view of the head clip pillow of FIG. 5, the head clip pillow being disposed upon a wearer, and being shown in broken lines to show the various components of the head clip pillow in relation to each other and the user's head.

Referring to FIG. 2, the pillow 10 includes a base member 16. The base member 16 is fabricated from a resilient material, such as a medium to low density polyethylene. The base member 16 may be formed in any conventional manner such as by die cutting, molding, or other similar process. As illustrated in FIG. 7, the base member 16 defines a contour substantially proportional to the overall contour of the pillow 10, with a central portion 18 relatively narrow with respect the terminal portions 20. In the preferred embodiment, the terminal portions 20 define a perimeter extending on an upper limit to approximately the ears of the user without covering the ears. Greater comfort has been experienced by forgoing the application of direct pressure to the ears. However, it will be understood that the present invention may be modified such that the base member 16 covers the ears if required in particular applications.

A spring member 22 is received about a portion of the base member 16. The spring member 22 is specifically configured to apply a biasing force about the neck of the user. Pressure applied to other areas of the user's head is accomplished indirectly through the base member 16. The spring member 22 is fabricated from a resilient material such as high density polypropylene and is either die cut or injection molded. Alternately, the spring member 22 may be fabricated from a selected metal composite and bent to shape. Further, in an alternate embodiment, the spring member 22 is integrally molded with the base member 16. It will be understood that though integrally molded together, the base member 16 and spring member 22 may each be fabricated from different select materials to accomplish the objectives of each. When separately formed, the spring member 22 is secured to the base member 16 in a conventional manner such as by rivets, ultrasonic welding, cementing, or the like. Due to the required flexibility of the pillow for insertion and removal of a user's head, and application of sufficient pressure to the user's head to maintain the position thereof, it will be understood that the manner in which the base member 16 and spring member 22 are secured must allow for the bending thereof.

Surrounding the base member 16 and spring member 22 is at least one layer of foam rubber or other cushioning type material 24. Conventional materials such as foam rubber, cotton or synthetic batting, and other materials have been used individually and in combination to achieve varying results. Accordingly, it is not intended that the present invention be limited to either material or combination thereof. For a foam rubber layer, a preferred construction includes a one inch (1") layer of eleven pound (11#) polyurethane disposed on each of the interior and the exterior of the base member 16 and spring member 22 construction. The two layers are glued together with a latex bond applied to the outer surfaces and then pinch pleated together in order to define a rounded edge about the perimeter of the pillow. A layer of one-half inch (½") polyester resin treated resin is disposed about the foam rubber core and is secured thereto with a latex bond or may be sewn as a sheath to cover the foam rubber core. It will be understood, however, that other materials, thicknesses of materials, and/or fastening or securement mechanisms may be used with similar results.

A cover 26 is provided for maintaining the integrity of the internal pillow components as heretofore described. The cover 26 is fabricated from a selected material such as cotton, and is sewn in place, such as by using a blind sewing technique. The cover 26 is configured to be closely received about the entirety of the pillow 10 to provide a smooth surface over the entire surface thereof. Finally, the removable cover 28 is provided to protect the pillow 10, and as described above, may be removed for cleaning or replacement thereof.

Figure 3:
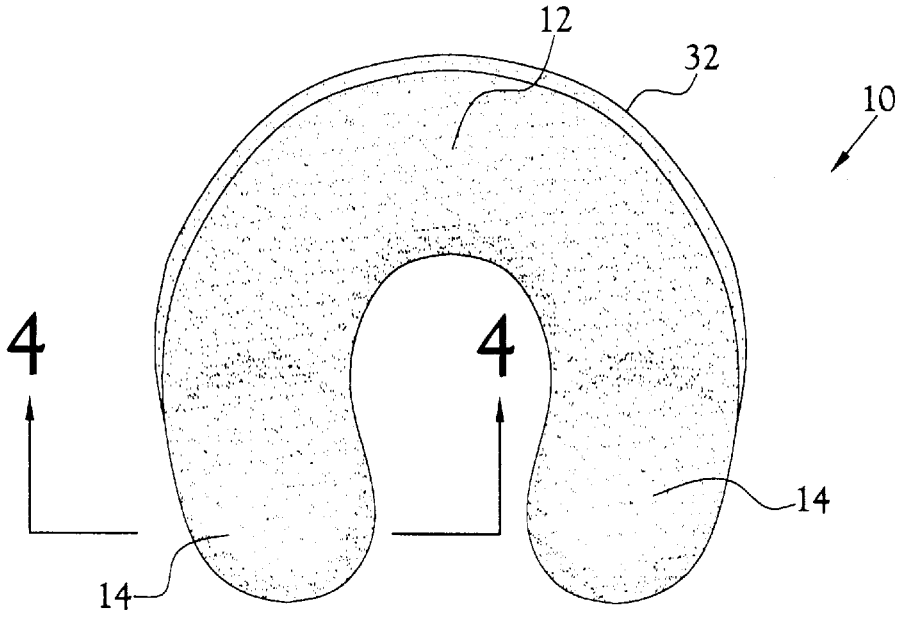
FIG. 3 is a top plan view of the head clip pillow of FIG. 1.
Figure 4:
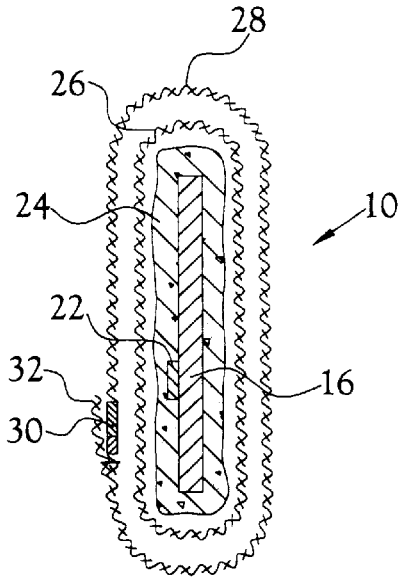
FIG. 4 is a front elevation view, in section, of the head clip pillow taken at 4—4 of FIG. 3.

FIG. 3 illustrates a top plan view of the pillow 10 of the present invention. Specifically, FIG. 3 illustrates the rising contour of the pillow 10 from the central portion 12 to the terminal portions 14 thereof. FIG. 4 illustrates, in cross-section, a front elevation view of the pillow 10 of the present invention, showing the relationship between the various components of the present invention. Specifically, FIG. 4 illustrates the zipper 30 used to accomplishment removal of the removable cover 28. Further illustrated is the zipper flap 32 provided to hide the zipper 30 both for protection thereof, and for aesthetic value.

Figure 5:
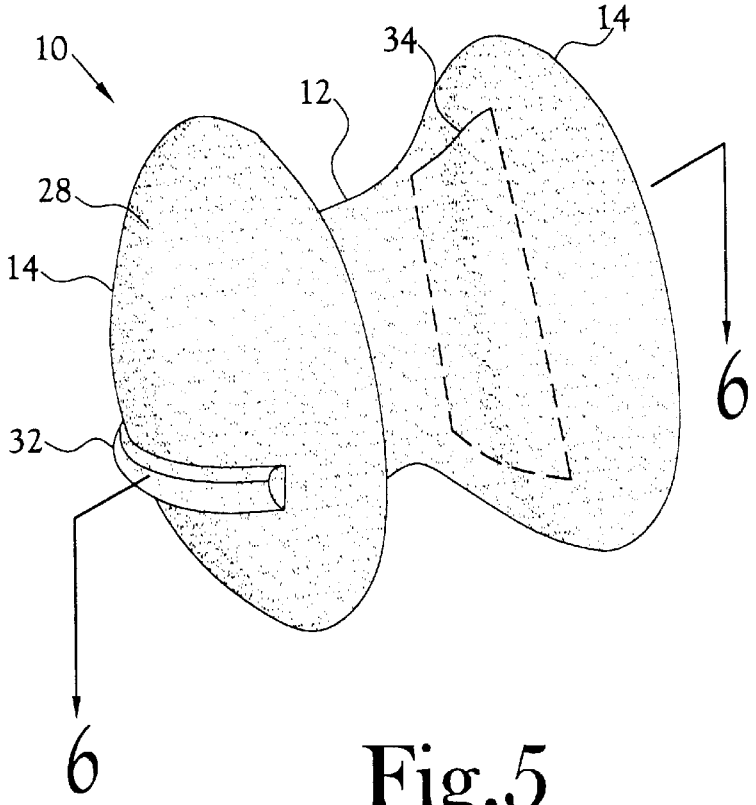
FIG. 5 is a perspective view of an alternate embodiment of the head clip pillow of the present invention.
Figure 6:
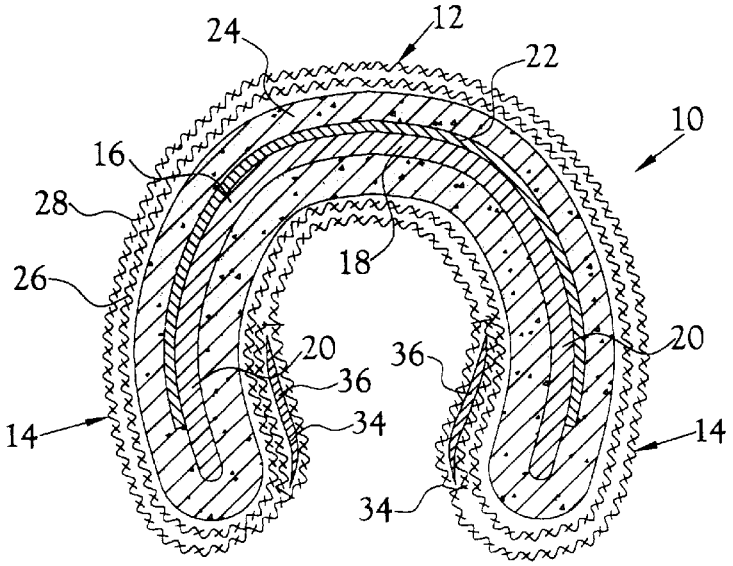
FIG. 6 is a top plan view, in section, of the head clip pillow taken at 6—6 of FIG. 5.

Illustrated in FIGS. 5 and 6 is an alternate embodiment of the present invention which includes a pocket 34 defined on the interior of each side of the removable cover 28. Each pocket 34 has a conventional closure device such as a hook-and-loop fastener. The pocket is configured to receive a therapeutic treatment device 36 such as a conventional hot/cold pack. As illustrated in FIG. 7, each pocket 34 is oriented in relation to the user's face to cover a substantial portion of the cheek and ear. The application of hot/cold packs 36 is known to provide therapeutic benefit when suffering from temporomandibular joint (TMJ) syndrome, tooth aches, ear aches, and other physical ailments in this region of the human body. Other ailments may be aided in various other treatments. The pockets 34 provided in the illustrated embodiment are configured to receive such therapeutic aids 36 and hold them in close relationship to the particular body portion to be treated.

Although not illustrated, speakers may be disposed within the pillow 10 on the base member 16 thereof for providing entertainment. However, in another application of the same structure, speakers may be used to reduce active sounds for a patient suffering from tinnitus.

Figure 8:
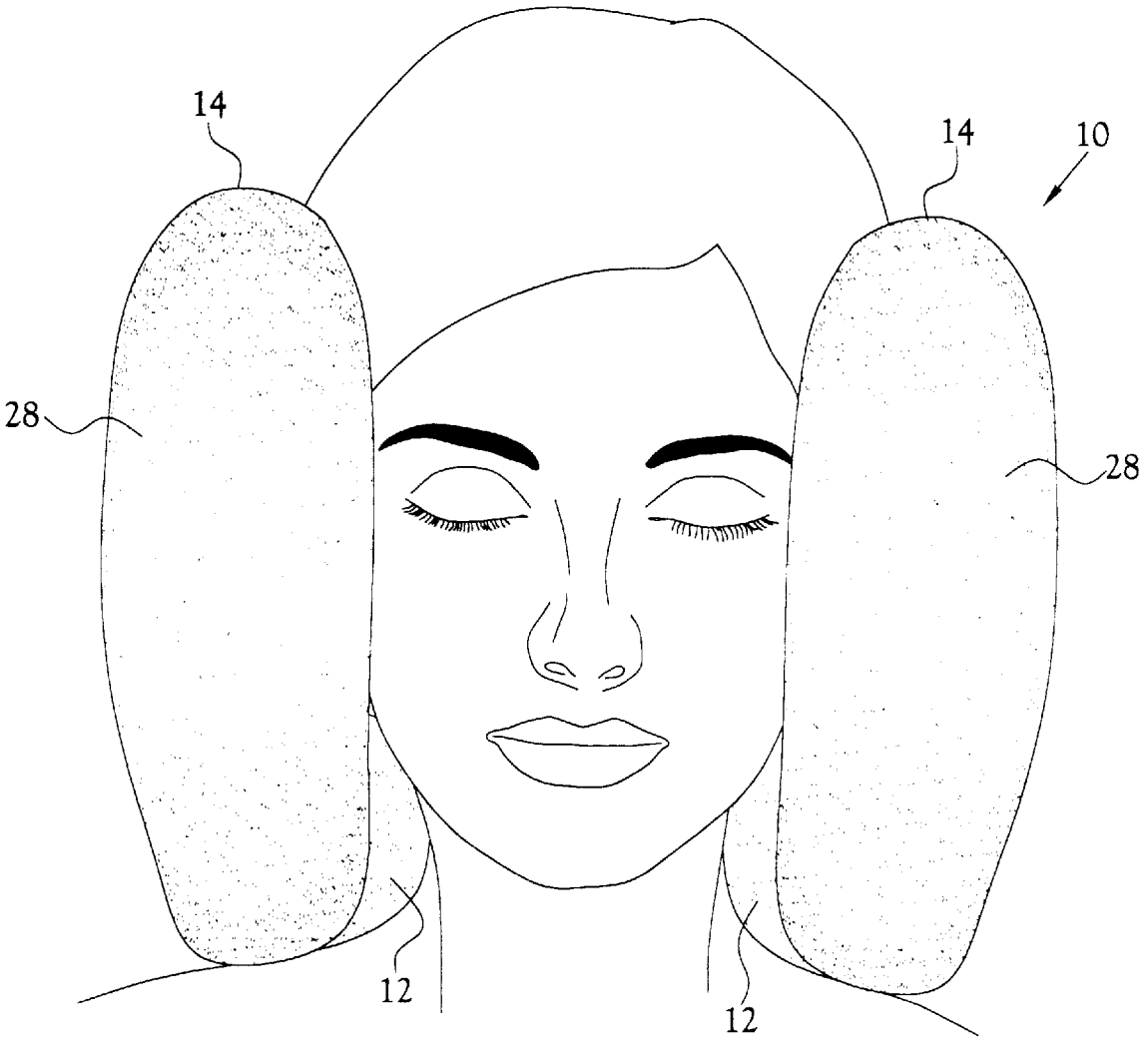
FIG. 8 is a front elevation view of the head clip pillow as disposed on a wearer.

FIG. 8 illustrates a preferred use of the pillow 10 of the present invention. In this use, the pillow 10 is positioned around the neck, with the terminal portions 14 substantially covering the sides of the user's face. In this disposition, several benefits are achieved. The pillow 10 provides at least partial immobilization of the head of the user, thereby providing support to the user's head when sleeping in a seated position, as when traveling in various modes of transportation. The pillow 10 also provides a sound damping effect and a visual shield from peripheral objects and/or activity, thereby creating an overall barrier to better define personal space when in public settings.

However, other dispositions of the present invention may be used as well. For example, the central portion 12 of the pillow may be disposed under the chin of the user, with the terminal portions 14 covering the sides of the user's face. Benefits of this disposition are similar to those of the above-described and illustrated use. Another alternate disposition of the present invention is to place the pillow 10 around one of the extremities, and specifically about a user's knee or elbow for applying therapeutic treatment thereto. The spring member 22 in either of these applications serves to hold the particular therapeutic aid 36 in position relative to the area to be treated. The base member 16 serves to distribute the compression force applied by the spring member 22, thus providing a larger area of compression to hold the therapeutic aid 36 in place.

From the foregoing description, it will be recognized by those skilled in the art that a head clip pillow offering advantages over the prior art has been provided. Specifically, the pillow is configured to be worn about the neck of a user to cover the user's ears in order to eliminate a substantial portion of ambient noise. Further, the pillow is configured to include a biasing device for applying sufficient force about the user's neck to maintain the pillow on the neck and over the ears of the user without creating discomfort to the user. In an alternate embodiment of the present invention, the pillow is configured to be worn about the neck and over the ears of a user to accommodate the application of therapeutic treatment. In either embodiment, but especially the latter, the pillow is configured to be worn about a user's extremities to accomplish therapeutic treatment of various other body parts such as knees and elbows.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A pillow for being worn about the neck of a user to cover the user's ears in order to eliminate a substantial portion of ambient noise, said pillow comprising:

a base member fabricated from a resilient material and formed in a conventional manner, said base member defining a contour having a central portion dimensioned to be received around the nape of the neck of a user and enlarged terminal portions dimensioned to coincide with a substantial portion of the face of the user;

a spring member received about a portion of said base member, said spring member being configured to apply a biasing force about the neck of the user to maintain said pillow in a selected position, said spring being fabricated from a resilient material, said spring member defining a substantially U-shaped configuration;

at least one layer of cushioning material disposed about said base member and said spring member; and a cover configured to be closely received about said at least one layer of cushioning material;

said pillow defining central portion having a height to be received by the nape of the neck and terminal portions having a height to cover the sides of the face of the user.

2. The pillow of claim 1 wherein said base member is fabricated from a medium to low density polyethylene.

3. The pillow of claim 1 wherein said base member terminal portions define a perimeter extending on an upper limit to approximately the ears of the user without covering the ears such that direct pressure is not applied to the ears of the user.

4. The pillow of claim 1 wherein said spring member is fabricated from high density polypropylene.

5. The pillow of claim 4 wherein said spring member and said base member are integrally formed.

6. The pillow of claim 5 wherein said spring member is fabricated from a first selected material and said base member is fabricated from a second selected material.

7. The pillow of claim 1 wherein said spring member is fabricated from a selected metal composite.

8. The pillow of claim 1 wherein said at least one layer of cushioning material is fabricated from at least one of the group consisting of at least polyurethane foam rubber, cotton batting, and synthetic batting.

9. The pillow of claim 1 further comprising a removable cover configured to be releasably secured over said pillow such as to accommodate removal thereof, said removable cover including a conventional closure device for accomplishing removal of said removable cover.

10. The pillow of claim 9 wherein said removable cover defines a pocket on an interior of each side thereof, said pocket including a conventional closure device and being configured to receive a therapeutic treatment device to be positioned over a particular body portion of the user to be treated.

11. A pillow for being worn about the neck of a user to cover the user's ears in order to eliminate a substantial portion of ambient noise, said pillow comprising:

a base member fabricated from a resilient material and formed in a conventional manner, said base member defining a contour having a central portion dimensioned to be received around the nape of the neck of a user and enlarged terminal portions dimensioned to coincide with a substantial portion of the face of the user, said base member terminal portions define a perimeter extending on an upper limit to approximately the ears of the user without covering the ears such that direct pressure is not applied to the ears of the user;

a spring member received about a portion of said base member, said spring member being configured to apply a biasing force about the neck of the user to maintain said pillow in a selected position, said spring being fabricated from a resilient material, said spring member defining a substantially U-shaped configuration;

at least one layer of cushioning material disposed about said base member and said spring member;

a cover configured to be closely received about said at least one layer of cushioning material; and a removable cover configured to be releasably secured over said pillow such as to accommodate removal thereof, said removable cover including a conventional closure device for accomplishing removal of said removable cover;

said pillow defining central portion having a height to be received by the nape of the neck and terminal portions having a height to cover the sides of the face of the user.

12. The pillow of claim 11 wherein said base member is fabricated from a medium to los density polyethylene.

13. The pillow of claim 11 wherein said spring member is fabricated from high density polypropylene.

14. The pillow of claim 13 wherein said spring member and said base member are integrally formed.

15. The pillow of claim 14 wherein said spring member is fabricated from a first selected material and said base member is fabricated from a second selected material.

16. The pillow of claim 11 wherein said spring member is fabricated from a selected metal composite.

17. The pillow of claim 11 wherein said at least one layer of cushioning material is fabricated from at least one of the group consisting of at least polyurethane foam rubber, cotton batting, and synthetic batting.

18. The pillow of claim 11 wherein said removable cover defines a pocket on an interior of each side thereof, said pocket including a conventional closure device and being configured to receive a therapeutic treatment device to be positioned over a particular body portion of the user to be treated.

* * * * *